United States Patent [19]

Mitchell

[11] Patent Number: 4,675,914

[45] Date of Patent: Jun. 30, 1987

[54] HARD-GRIP GLOVE

[76] Inventor: Rodger Mitchell, 921 Pontiac, Wilmette, Ill. 60091

[21] Appl. No.: 862,262

[22] Filed: May 12, 1986

[51] Int. Cl.[4] ..... A41D 19/00

[52] U.S. Cl. ..... 2/161 A; 2/159; 2/166

[58] Field of Search ..... 2/161 A, 159, 160, 163, 2/161 R, 166, 167, DIG. 6

[56] References Cited

U.S. PATENT DOCUMENTS

| | | | |
|---|---|---|---|
| 695,586 | 3/1902 | Steele | 2/166 |
| 2,154,197 | 4/1939 | Callaway | 2/161 R |
| 3,062,546 | 11/1962 | Horton et al. | 2/161 A |
| 3,333,850 | 8/1967 | Miller | 2/161 A |
| 3,593,803 | 7/1971 | Ibach | 2/21 |
| 3,835,472 | 9/1974 | Duggins | 2/161 A |
| 3,944,220 | 3/1976 | Fasano | 2/159 |
| 4,000,903 | 1/1977 | Swanson | 2/161 A |
| 4,051,553 | 10/1977 | Howard | 2/161 A |
| 4,089,070 | 5/1978 | Cherry | 2/161 A |
| 4,247,097 | 1/1981 | Schwartz | 2/161 A |

OTHER PUBLICATIONS

Gershman, "Journal of AMA", vol. 168, No. 7, Sel-f-Adhering Nylon Tapes, 10-1958, p. 980.

*Primary Examiner*—Werner H. Schroeder
*Assistant Examiner*—Mary A. Ellis
*Attorney, Agent, or Firm*—August E. Roehrig, Jr.

[57] ABSTRACT

There is provided various embodiments of a gripping glove having a plurality of spring members which are positionable to impose a selective gripping force to the fingers of a user to improve the user's grip. The gripping glove utilizes U-shaped springs which in one embodiment are sewn into the glove overlying each of the user's fingers to provide an improved gripping force. In another embodiment, the U-shaped springs are incorporated in a pocket which is affixed to the back of a glove. In a third embodiment, the U-shaped grip enhancing springs are incorporated in a pocket having a releasable fastening surface, such as Velcro, to enable springs of different force to be readily interchangeably used and removed from the glove.

9 Claims, 7 Drawing Figures

FIG. 1
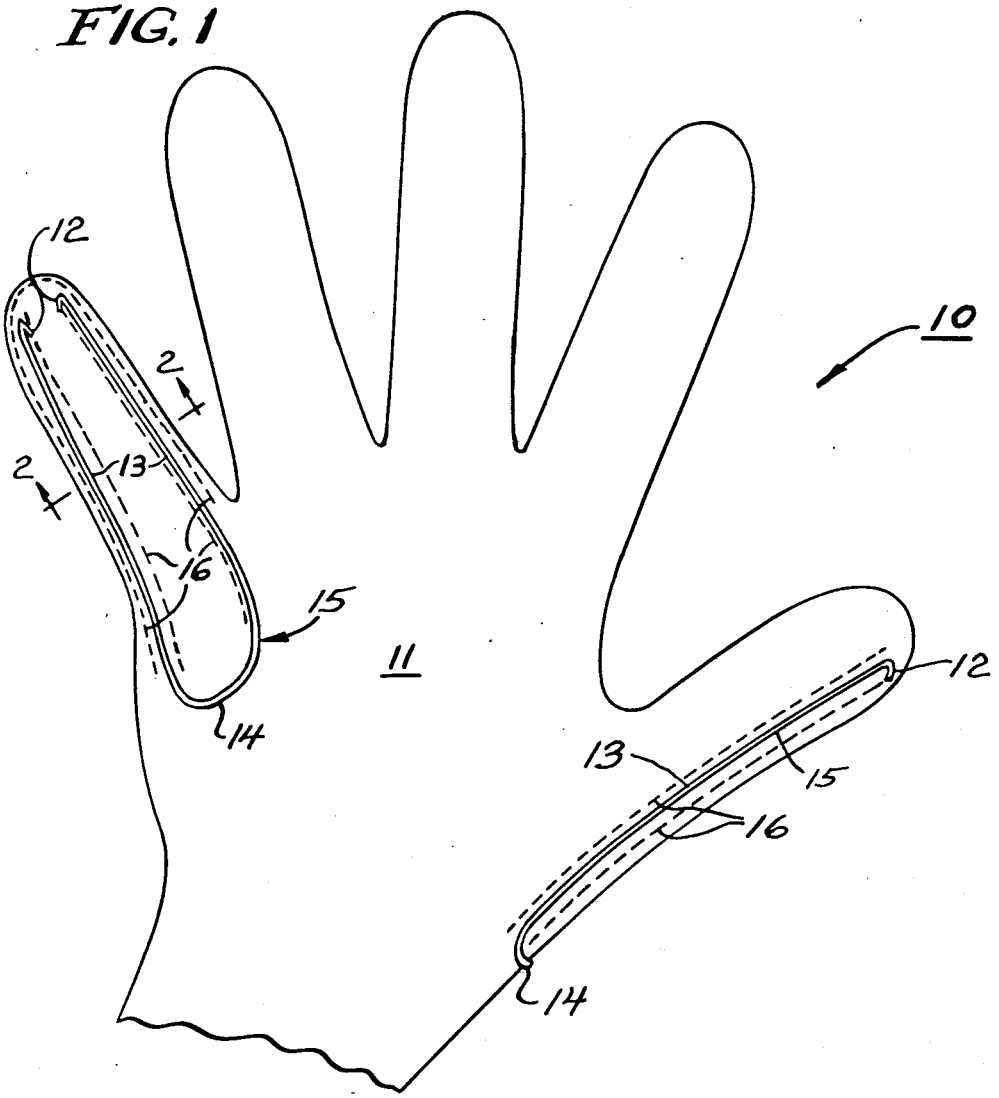
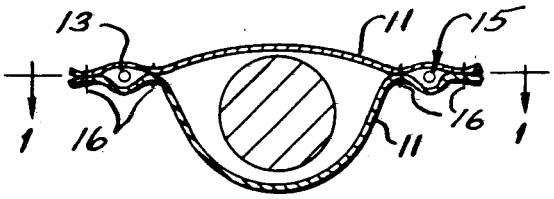
FIG. 2

FIG. 3
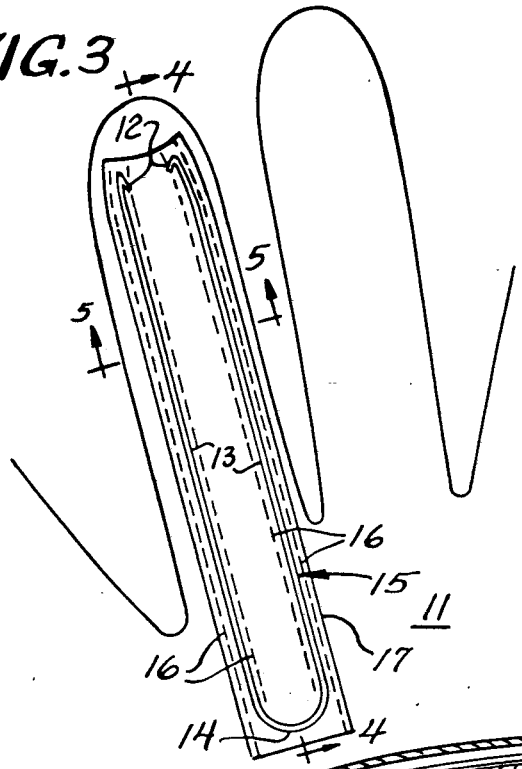
FIG. 5
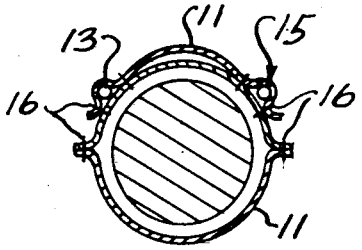
FIG. 4
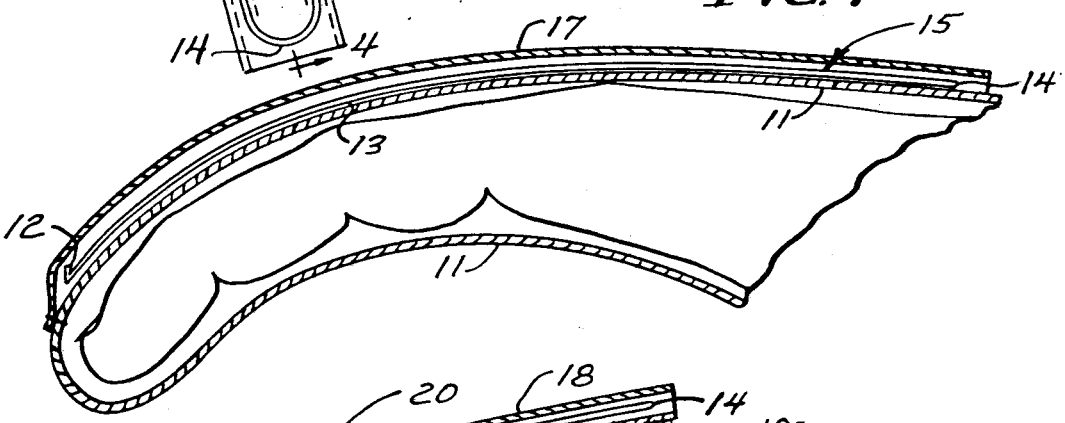
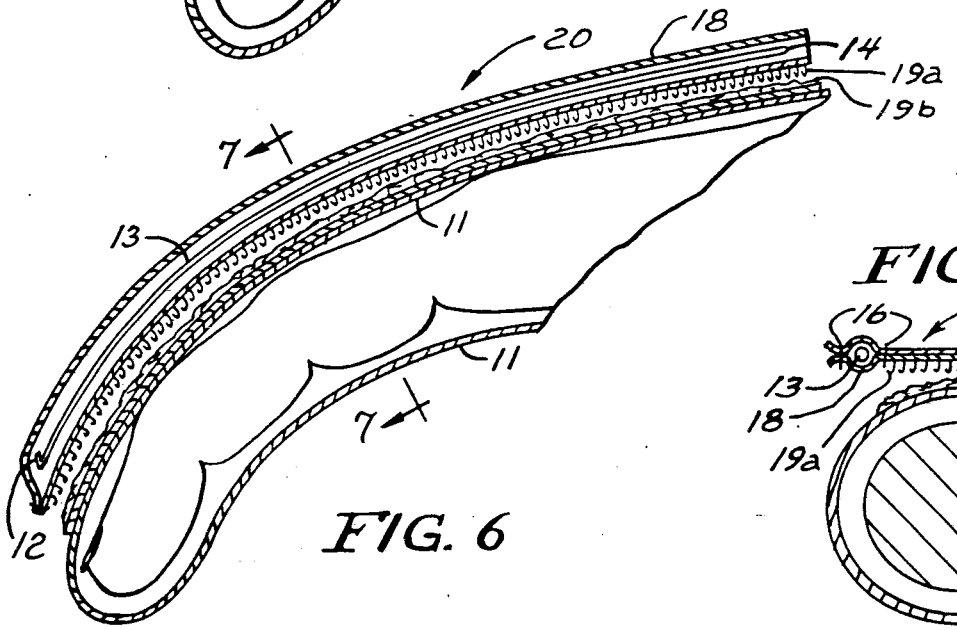
FIG. 6
FIG. 7
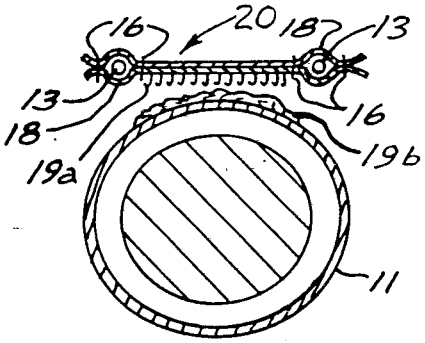

HARD-GRIP GLOVE

BACKGROUND OF THE INVENTION

This invention relates in general to a glove for improved gripping and, in particular, to a glove incorporating a mechanical system for providing an increased gripping force to the user.

More specifically, but without restriction to the particular embodiments and/or use which are shown and described for purposes of illustration, this invention relates to a gripping glove incorporating precoiled spring assemblies for imposing an auxiliary gripping force on the individual fingers of the user when wearing the glove.

In recreational or sports activities such as tennis, golf, baseball or racketball, for example, one of the important factors in determining player proficiency is the manner in which a racket, club or bat is gripped by the user. If an insufficient amount of gripping force is used, the racket or club will twist in the hand upon impact with a ball, causing the ball to be misdirected. Many sports enthusiasts, in an attempt to prevent this from happening, concentrate so much on gripping the racket, club or bat tightly that an incorrect swing occurs.

Since many such sports permit a player to utilize a glove to improve gripping, incorporating a grip-enhancing force applying system into the glove would increase the user's gripping force. Such a glove would be an improvement over those presently available, which only enhance the frictional relationship between the material of the glove and the sobject to be gripped. The glove would provide an increased gripping force so that a user would be able to grip with a sufficient gripping force to prevent the racket or club from twisting, while permitting the user to concentrate more on a proper swing in order to improve game proficiency.

Since it would be desirable to vary the amount of force to accommodate individual players, a further feature of such a gripping glove is to permit variation of the magnitude of the auxiliary gripping force applied to adjoining fingers, and to even permit changes in the force applied to an individual finger as the player's abilities or physical conditioning changes.

SUMMARY OF THE INVENTION

It is, therefore, an object of this invention to provide a sports glove incorporating a gripping force applying system.

Another object of this invention is to vary the individual force applied to fingers inserted into the gripping glove.

A further object of this invention is to provide an interchangeable system of force application so that the gripping force applied to individual fingers of the gripping glove can be varied with the preference of the user.

These and other objects are attained in accordance with the present invention wherein there is provided various embodiments of a gripping glove having a plurality of spring members which are positionable to impose a selective gripping force to the fingers of a user to improve the user's grip. The gripping glove utilizes U-shaped springs which in one embodiment are sewn into the glove overlying or being positioned alongside of each of the user's fingers to provide an improved gripping force. While U-shaped springs are preferred as providing more lateral stability, it is to be understood that a pair of individual springs may be substituted therefor, with one spring being positioned on top of or alongside of each finger. In another embodiment, the U-shaped springs are incorporated in a pocket which is affixed to the back of a glove. In a third embodiment, the U-shaped grip enhancing springs are incorporated in a pocket having a releasable fastening surface to enable springs of different force to be readily interchangeably used and removed from the glove.

DESCRIPTION OF THE DRAWINGS

Further objects of the invention together with additional features contributing thereto and advantages accruing therefrom will be apparent from the following description of preferred embodiments of the invention which are shown in the accompanying drawings with like reference numerals indicating corresponding parts throughout, wherein:

FIG. 1 is a planar view of the back of a gripping glove illustrating two grip-enhancing springs sewn into the glove to improve the user's grip;

FIG. 2 is an enlarged cross-sectional view of the glove shown in FIG. 1 taken along lines 2—2;

FIG. 3 is a partial view of the gripping glove to illustrate a grip-enhancing spring carried within a pocket which may be permanently affixed to the glove;

FIG. 4 is an enlarged side elevation of the glove finger illustrated in FIG. 3 taken along the lines 4—4 to better illustrate the pocket affixed to the gripping glove;

FIG. 5 is a cross-sectional view of FIG. 3 taken along the lines 5—5;

FIG. 6 is a profile view similar to FIG. 4 to illustrate the grip-enhancing springs incorporated in a removable pocket which may be selectively secured onto the glove back by means of Velcro releasable fasteners;

FIG. 7 is a cross-sectional view of the glove and removable pocket shown in FIG. 6 taken along lines 7—7.

DESCRIPTION OF PREFERRED EMBODIMENTS

Referring now to FIG. 1, there is shown the back-of-hand view of a glove 10 used for engaging in sports such as tennis, golf or baseball and constructed by sewing together two or more pieces of material 11—cut into a hand-shaped configuration. The glove 10 is formed with portions for receiving the fingers 26 and thumb of the user, and may include ventilation holes and/or a friction enhancing gripping surface on its palm, neither of which are shown in the drawings. The embodiment illustrated in FIGS. 1 and 2 incorporates one or more grip-enhancing coil springs 15 which are permanently incorporated into the fingers 26 and thumb of the glove 10 by sewing. Although only two gripping springs 15 are illustrated in FIG. 1, it is to be understood that additional springs can be used, one for each finger 26, as desired. The gripping springs 15 are illustrated in the drawings in their stretched configurations, which is the configuration such springs incur when a gloved hand, for example, is placed flat, palm down, on a surface. However, when the gloved hand is raised from the surface, the coil springs 15 will attempt to coil upon themselves thereby exerting a grip forming force on each finger 26 adjacent to each spring.

As best illustrated in FIG. 2, a pair of seams 16 are formed on each side of the glove parallel to the portion formed for receiving a user's fingers 26. These seams are formed throughout the length of the glove fingers 26 and then on top of the glove to a sufficient distance such that the U-shaped gripping spring 15 will extend rearwardly so that the bight 14 of the U will extend past the knuckle joint formed between the hand and the base of the fingers 26.

The U-shaped gripping springs 15 are formed so that the free ends of each leg 13 are turned back onto themselves to form a hook 12 which secures the free end of the spring within the confines of the seamed "tunnel". The hook 12 so formed prevents the spring 15 from being pulled backward out from its covering enclosure. The extension of the gripping spring 15 beyond the knuckle joint between the hand and the fingers 26, allows the gripping spring 15 to impose its coiling force throughout the finger 26 length of the finger 26 by using the back of the hand as a fulcrum, and without interfering with finger 26 movement at the knuckle joint. By leaving the bight end 14 of the gripping spring free, the spring 15 can move longitudinally along the length of the finger 26 to accommodate movement of the spring during gripping of various objects while still controlling the relative position of the spring with regard to fingers 26 in the glove.

Referring to the second embodiment illustrated in FIGS. 3–5, the gripping spring 15 is shown sewn into a pocket which may be constructed onto an existing glove. As best shown in FIGS. 4 and 5, the gripping spring 15 is covered by a pocket forming material 17, and a pair of parallel stitches are formed on either side of each leg 13 to fasten the gripping spring 15 to the back of the gripping glove. In this embodiment, the free ends 12 of the gripping spring are similarly bent upon themselves to form a hook for fixing the free end in a predetermined location. Similarly, the bight portion 14 of the spring extends beyond the knuckle joint to facilitate use.

Referring to the third embodiment, the gripping spring 15, having its free ends 12 constructed as before and extending the length as previously discussed, is sewn between two pieces of material, or an overlapped material 18 to form a separte spring-enclosing pod 20. One surface of the material is formed from or covered with a portion of a Velcro or releasable fastening system 19*a* and 19*b*, such material being disclosed in U.S. Pat. No. 3,114,951. The glove fingers 26 are formed or covered with a mating portion of the Velcro or releasable fastening system, and in this manner individual pods 20 containing a gripping spring may be interchanged on the fingers 26 of the glove to vary the gripping force applied to an individual finger 26 in accordance with the preferences of the user. In this manner, individual spring forces can be applied to a particular finger 26, and the force applied through a particular finger 26 can be varied to accommodate changes in the user's grip by having springs of different coiling force enclosed in separate pods.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments illustrated by the drawings and described in the specification as the best mode presently contemplated for carrying out this invention, but that the invention will include any embodiments falling within the description of the appended claims.

I claim:

1. A gripping glove comprising a palm, finger, thumb and back portion for receiving the hand of a user, and a first grip-enhancing force applying means extending along said finger portion for applying a coiling force from the back of said finger portion to enhance the grip of the user.

2. The gripping glove of claim 1 further including a second grip-enhancing force applying means extending along said thumb portion for applying a coiling force through the back of said thumb portion to enhance the grip of the user.

3. The gripping glove of claim 2 wherein said first and second grip-enhancing force applying means is sewn onto said back portion.

4. The gripping glove of claim 2 wherein said first and second grip-enhancing force applying each comprise a U-shaped coil spring.

5. The gripping glove of claim 4 wherein the free ends of said U-shaped coil spring are turned upon themselves to form retaining hooks for securing said U-shaped coil spring onto said back portion.

6. The gripping glove of claim 4 wherein said U-shaped coil spring is sewn into said finger and thumb portions by stitching which extends parallel to said finger and thumb portions.

7. The gripping glove of claim 4 wherein said U-shaped coil spring is positioned on said back portion and affixed thereto by a pocket sewn to said back portion by parallel stitching formed on both sides of leg portions of said U-shaped coil spring.

8. The gripping glove of claim 1 wherein said first and second grip-enhancing force applying means each comprise a U-shaped coil spring enclosed within a covering having a back portion engaging surface of a releasably engaging material, and said back portion having a mating releasably engaging material carried thereon for selectively supporting said U-shaped coil spring along said finger portion.

9. The gripping glove of claim 5 wherein the bight portion of said U-shaped coil spring is movable longitudinally of said finger portion.

* * * * *